US009475168B2

(12) United States Patent
Qian et al.

(10) Patent No.: US 9,475,168 B2
(45) Date of Patent: Oct. 25, 2016

(54) POLISHING PAD WINDOW

(71) Applicants: Rohm and Haas Electronic Materials CMP Holdings, Inc., Newark, DE (US); Dow Global Technologies LLC, Midland, MI (US)

(72) Inventors: Bainian Qian, Newark, DE (US); Ethan Scott Simon, Abington, PA (US); George C. Jacob, Newark, DE (US)

( * ) Notice: Subject to any disclaimer, the term of this patent is extended or adjusted under 35 U.S.C. 154(b) by 47 days.

(21) Appl. No.: 14/669,421

(22) Filed: Mar. 26, 2015

(65) Prior Publication Data

US 2016/0279757 A1 Sep. 29, 2016

(51) Int. Cl.
*B24B 37/20* (2012.01)
*B24B 37/26* (2012.01)

(52) U.S. Cl.
CPC ..... *B24B 37/205* (2013.01); *B24B 37/26* (2013.01)

(58) Field of Classification Search
CPC ..... B24B 37/205; B24B 37/26
USPC ..... 451/5, 6, 41, 285–290, 527
See application file for complete search history.

(56) References Cited

U.S. PATENT DOCUMENTS 5,605,760 A 2/1997 Roberts
5,893,796 A * 4/1999 Birang ..... B24B 37/013 451/283
5,964,643 A * 10/1999 Birang ..... B24B 37/013 451/285
6,068,539 A * 5/2000 Bajaj ..... B24B 21/04 451/41
6,213,845 B1 * 4/2001 Elledge ..... B24B 37/205 451/299
6,247,998 B1 * 6/2001 Wiswesser ..... B24B 37/013 257/E21.23
6,309,276 B1 * 10/2001 Tsai ..... B24B 37/013 451/41
6,458,014 B1 10/2002 Ihsikawa et al.
6,599,765 B1 7/2003 Boyd et al.
6,623,331 B2 9/2003 Sevilla et al.
6,832,950 B2 12/2004 Wright et al.
6,913,514 B2 7/2005 Kimura et al.
6,984,163 B2 1/2006 Roberts
7,074,110 B1 * 7/2006 Wolf ..... B24B 49/12 451/288
7,258,602 B2 8/2007 Shih et al.
7,264,536 B2 9/2007 Wiswesser et al.
7,621,798 B1 11/2009 Bennett et al.
7,927,183 B2 4/2011 Fukuda et al.
7,942,724 B2 * 5/2011 Benvegnu ..... B24B 49/12 451/41
8,475,228 B2 7/2013 Benvegnu et al.
8,662,957 B2 * 3/2014 Paik ..... B24B 37/205 451/41
9,017,140 B2 * 4/2015 Allison ..... B24B 37/205 451/526
2003/0129931 A1 * 7/2003 Konno ..... B24B 37/205 451/285
2003/0171081 A1 9/2003 Komukai et al.
2005/0060943 A1 * 3/2005 Turner ..... B24B 37/205 51/297
2005/0090187 A1 * 4/2005 Shih ..... B24B 37/013 451/6
2007/0197147 A1 * 8/2007 Rondum ..... B24B 21/04 451/285

* cited by examiner

*Primary Examiner* — George Nguyen
(74) *Attorney, Agent, or Firm* — Blake T. Biederman

(57) ABSTRACT

The polishing pad is suitable for polishing or planarizing at least one of semiconductor, optical and magnetic substrates. The polishing pad has a polishing surface, an opening through the polishing pad and a transparent window within the opening in the polishing pad. The transparent window has a concave surface with a depth that increases with use of the polishing pad. A signal region slopes downward into the central region for facilitating debris removal and a debris drainage groove extending through the central region into the polishing pad. Rotating the polishing pad with polishing fluid in the debris drainage groove sends debris from the central region into the polishing pad through the debris drainage groove.

10 Claims, 6 Drawing Sheets

POLISHING PAD WINDOW

BACKGROUND

This specification relates to polishing pad windows useful for monitoring polishing rate and detecting polishing endpoints. In particular, it relates to a window configuration useful for limiting polishing defects or useful for reducing variation in signal transmission.

Polyurethane polishing pads are the primary pad-type for a variety of demanding precision polishing applications. For example, polyurethane polishing pads have high strength for resisting tearing; abrasion resistance for avoiding wear problems during polishing; and stability for resisting attack by strong acidic and strong caustic polishing solutions. These polyurethane polishing pads are effective for polishing multiple substrates, including the following: silicon wafers, gallium-arsenide and other Group III-V semiconductor wafers, SiC, patterned wafers, flat panel displays, glass, such as sapphire and magnetic storage disks. In particular, polyurethane polishing pads provide the mechanical integrity and chemical resistance for most polishing operations used to fabricate integrated circuits. Unfortunately, these polyurethane polishing pads tend to lack sufficient transparency sufficient for laser or optical endpoint detection during polishing.

Since the mid 1990s, optical monitoring systems with endpoint detection have served to determine polishing time with laser or optical endpointing for semiconductor applications. These optical monitoring systems provide in-situ endpoint detection of a wafer substrate during polishing with a light source and a light detector. The light source directs a light beam, passing it through a transparent window toward the substrate being polished. The light detector measures light reflected from the wafer substrate that passes one more time back through the transparent window. An optical path is formed from the light source, through the transparent window, onto the substrate being polished, the reflected light passing through the transparent window again and into the light detector.

Typically, the transparent window is coplanar with the polishing surface of the polishing pads. Alternative designs, however contain a recess between the window and the wafer substrate. During polishing, this recess fills with slurry. If the recess is too deep, then the slurry, together with polishing debris, can block or diffuse the optical path and there can be insufficient signal strength to achieve reliable endpoint detection. The accumulated polishing debris on a recessed window surface can scratch the wafer substrate and create defects in the resulting semiconductor.

There remains a need for a window having improved optical signal strength with a decreased risk of creating polishing defects in the wafer.

STATEMENT OF INVENTION

An aspect of the invention provides a polishing pad suitable for polishing or planarizing at least one of semiconductor, optical and magnetic substrates, the polishing pad having a polishing surface, an opening through the polishing pad, a radius that extends from a center of the polishing pad to a perimeter of the polishing pad and a transparent window within the opening in the polishing pad, the transparent window being secured to the polishing pad and transparent to at least one of magnetic and optical signals, the transparent window having a concave surface with respect to the polishing surface, the concave surface having a maximum depth in a central region of the transparent window as measured from a plane of the polishing surface that increases with use of the polishing pad; a signal region in the transparent window adjacent the central region and on a side closest to the center of the polishing pad for transmitting at least one of optical and or magnetic signals to a wafer, the signal region sloping downward into the central region for facilitating debris removal and a debris drainage groove extending through the central region into the polishing pad wherein rotating the polishing pad with polishing fluid in the debris drainage groove sends debris from the central region into the polishing pad through the debris drainage groove and wherein the depth of the debris drainage groove is greater than the depth of the central region.

Another aspect of the invention provides a polishing pad suitable for polishing or planarizing at least one of semiconductor, optical and magnetic substrates, the polishing pad containing fluid-filled microspheres and having a polishing surface, an opening through the polishing pad, a radius that extends from a center of the polishing pad to a perimeter of the polishing pad and a transparent window within the opening in the polishing pad, the transparent window being secured to the polishing pad with a lateral spacing less than an average diameter of the fluid-filled microspheres and transparent to at least one of magnetic and optical signals, the transparent window having a concave surface with respect to the polishing surface, the concave surface having a maximum depth in a central region of the transparent window as measured from a plane of the polishing surface that increases with use of the polishing pad; a signal region in the transparent window adjacent the central region and on a side closest to the center of the polishing pad for transmitting at least one of optical and or magnetic signals to a wafer, the signal region sloping downward into the central region for facilitating debris removal and a debris drainage groove extending through the central region into the polishing pad wherein rotating the polishing pad with polishing fluid in the debris drainage groove sends debris from the central region into the polishing pad through the debris drainage groove and wherein the depth of the debris drainage groove is greater than the depth of the central region.

DESCRIPTION OF PREFERRED EMBODIMENT

The polishing pad of the invention is suitable for polishing or planarizing at least one of semiconductor, optical and magnetic substrates. Preferably, the pad polishes or planarizes a semiconductor substrate. The polishing pad may be a porous or non-porous substrate. Examples of porous substrates include frothed pads, extruded pads containing dissolved gas and matrices embedded with hollow polymeric microspheres. A transparent window transparent to at least one of magnetic and optical signals is secured to the polishing pad. Preferably, the window is transparent to optical signals. Unfilled polyurethane materials can have an excellent combination of transparency, polishing ability and low defectivity for polishing semiconductor substrates. Typically these polyurethanes represent a blend of aliphatic polyurethanes for transparency and aromatic polyurethanes for strength.

In CMP pads formed without adequate cushion between the window and polishing pad, a shallow cavity forms as the window becomes more concave. The transparent window forms a concave surface with respect to the polishing surface during manufacture or polishing. The concave surface has a maximum depth in a central region of the transparent window as measured from a plane of the polishing surface that increases with use of the polishing pad. A small or no spacing between the window and the polishing pad can exacerbate the depth of the concave transparent window. Furthermore, fluid-filled polymeric microspheres in the polishing pad can further exacerbate the depth of the concave transparent window. For example, compressing the microspheres filled with gas, liquid or a gas-liquid mixture can concentrate forces applied against the window. This shallow cavity can fill with slurry and polishing debris that impede the signal strength through the window. As the window becomes more concave, the cavity becomes deeper and additional slurry and polishing debris tend to accumulate further reducing signal strength. In the polishing pad of the invention, the signal region slopes downward into the central region for facilitating slurry and polishing debris removal and a debris drainage groove extends through the central region into the polishing pad. Rotating the polishing pad with polishing fluid in the debris drainage groove sends polishing debris from the central region of the transparent window into the polishing pad groove. Although all the Figures illustrate a rectangular-shaped window, alternatively, the window can have a round, square, oval or other shape.

Figure 1A:
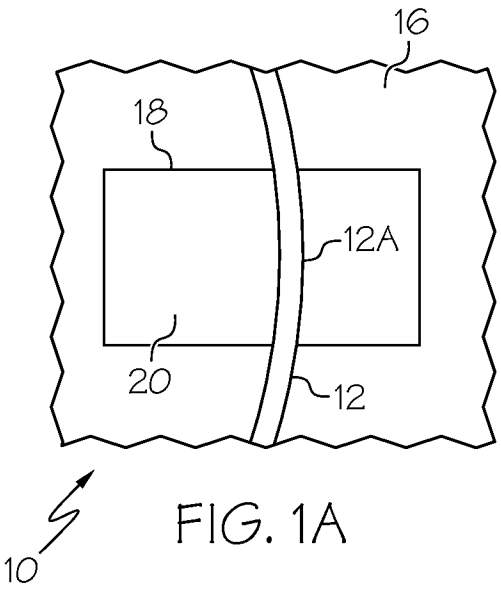
FIG. 1A is an enlarged schematic drawing of a drained window of FIG. 1.
Figure 1:
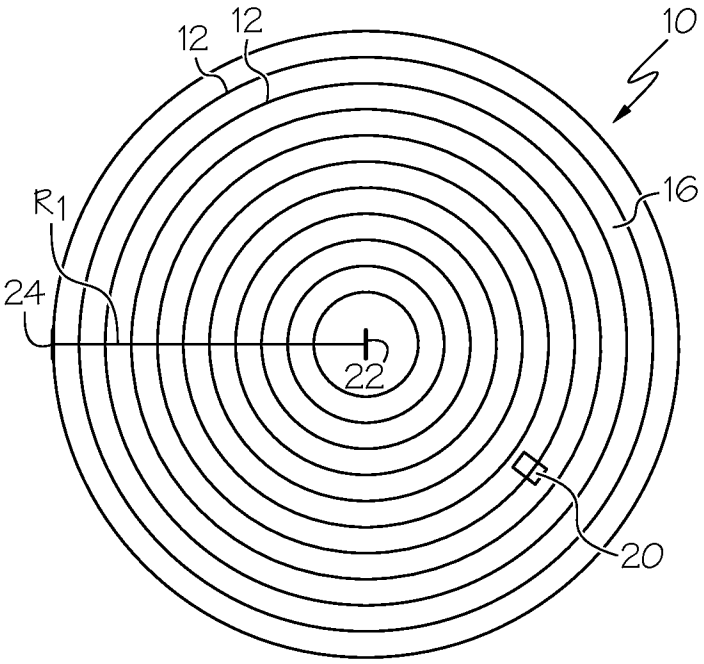
FIG. 1 is a schematic drawing of a drained window of the invention having a circumferential groove contiguous with a circumferential polishing pad groove.

Referring to FIGS. 1 and 1A, the polishing pad 10 having circular grooves 12 can polish or planarize semiconductor, optical or magnetic substrates (not illustrated). The polishing pad typically includes a porous polyurethane matrix, but the matrix can be other polymers. Optionally, the polymeric matrix of the polishing pad 10 includes fluid-filled microspheres (not illustrated). Alternatively, the grooves can be combined with spiral, low flow grooves, X-Y grooves, concentric hexagons, concentric dodecagons, concentric hexdecagons, polygonal or other known groove shape. The polishing pad 10 has a polishing surface 16 that interacts with the semiconductor, optical or magnetic substrate. An opening 18 through the polishing pad 10 provides a location for securing a transparent window 20. When the polymeric matrix of the polishing pad 10 includes fluid-filled microspheres, they are preferably secured with a lateral spacing less than an average diameter of the fluid-filled microspheres. For example, casting the window in place provides a direct bond between the transparent window 20 and polishing pad 10 with essentially no space between transparent window 20 and polishing pad 10. A radius $R_1$ extends from the center 22 to the perimeter 24 of the polishing pad 10. Referring to FIG. 1A, a circular groove 12 extends into the arc-shaped debris drainage groove 12A to facilitate debris removal. The arc-shaped debris drainage groove 12A runs the entire width of the transparent window 20.

Figure 1B:
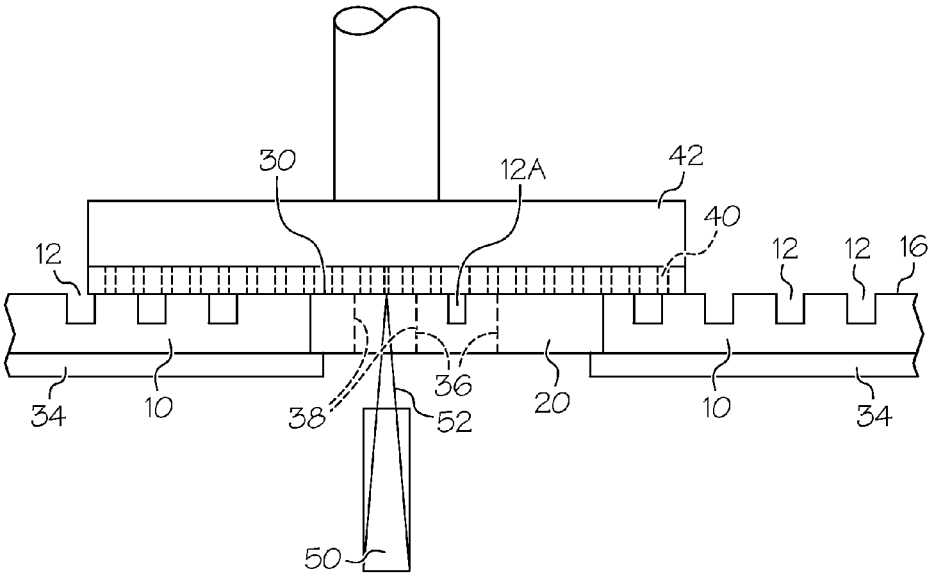
FIG. 1B is a radial cross section of the drained window of the FIG. 1 having a circumferential groove contiguous with a circumferential polishing pad groove prior to polishing.
Figure 1C:
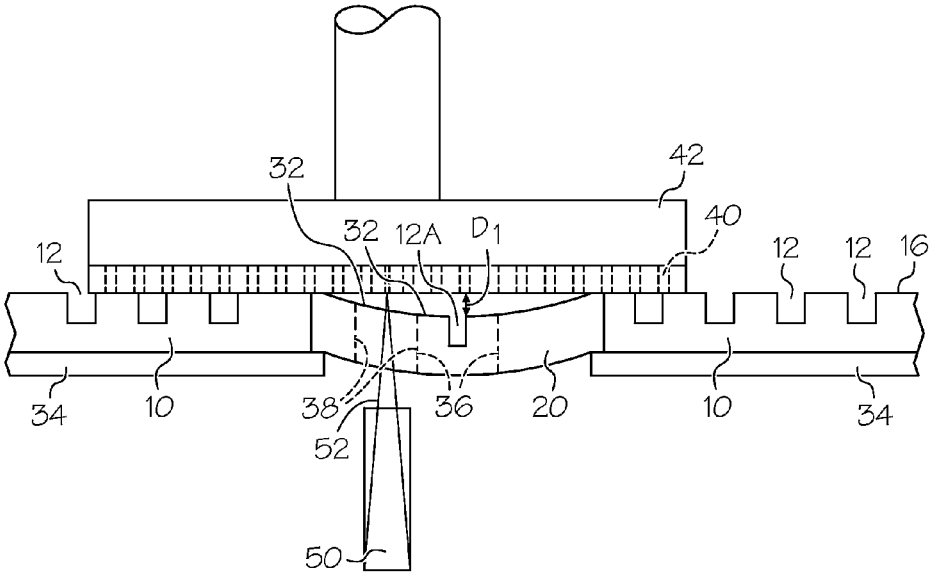
FIG. 1C is a radial cross section of a drained window of FIG. 1 having a circumferential groove contiguous with a circumferential polishing pad groove after polishing multiple wafers.

Referring to FIGS. 1B and 1C, the window 20 of polishing pad 10 can have either a flat surface 30 parallel with polishing surface 16 or concave surface 32 as measured with respect to the polishing surface 16. A subpad 34 supports the polishing pad 10 and the outer perimeter of the window 20. During polishing, the window 20 deforms and becomes concave. Typically, the window 20 becomes more and more concave as the polishing continues. The pad 10 optionally starts with a concave surface 32. The concave surface 32 has a maximum depth $D_1$ in a central region 36 of the transparent window 20 as measured from a plane of the polishing surface 16. During polishing the window 20 deforms to increase the height of $D_1$. A signal region 38 in the transparent window 20 is adjacent the central region 36 and on a side closest to the center 22 (FIG. 1) of the polishing pad 10. The signal region 38 transmits at least one of optical and or magnetic signals to a wafer 40 held by wafer carrier 42. The signal region 38 slopes downward into the central region 36 for facilitating debris removal. The arc-shaped debris drainage groove 12A extends through the central region 36 into the polishing pad 10 wherein rotating the polishing pad 10 with polishing fluid in the arc-shaped debris drainage groove 12A sends debris from the central region 36 into the polishing pad 10 through the arc-shaped debris drainage groove 12A. The depth of the arc-shaped debris drainage groove 12A is greater than the depth $D_1$ of the central region 36 as measured from the plane of the polishing surface 16.

During polishing endpoint detector 50 sends signal 52 through the signal region 38 of the transparent window 20 where it strikes wafer 40. The signal 52 then returns through signal region 38 where the endpoint detector 50 determines whether to continue or cease polishing of the wafer 40.

Figure 2A:
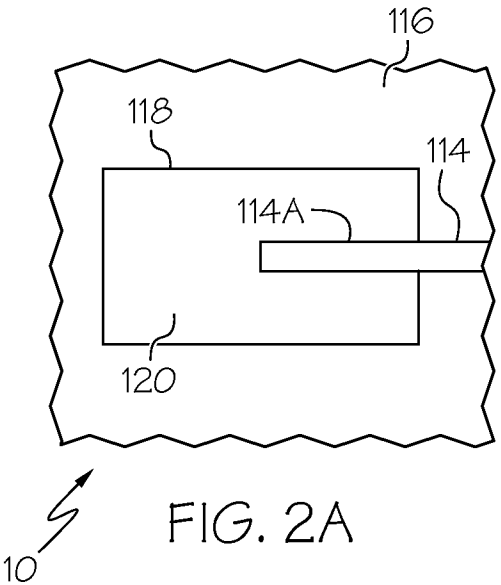
FIG. 2A is an enlarged schematic drawing of a drained window of FIG. 2.
Figure 2:
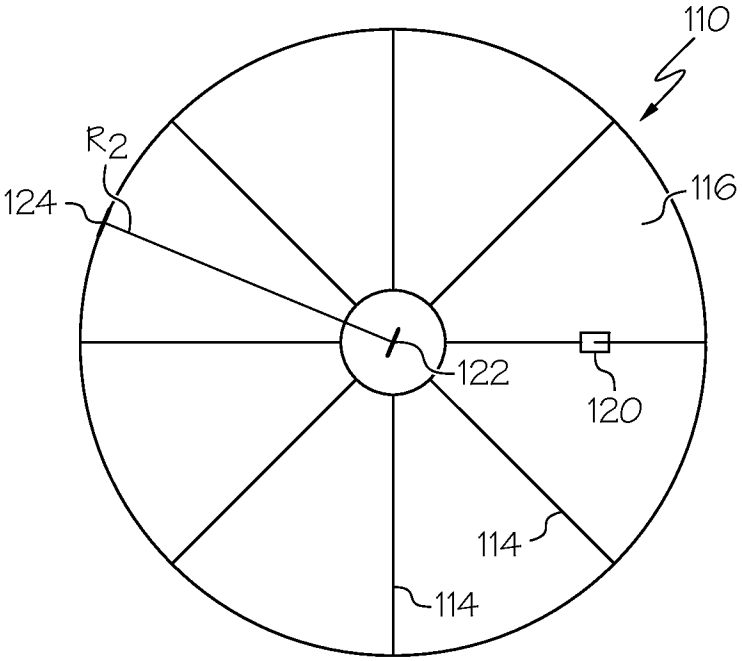
FIG. 2 is a schematic drawing of a drained window of the invention having a radial groove contiguous with a radial polishing pad groove.

Referring to FIGS. 2 and 2A, the polishing pad 110 having radial grooves 114 can polish or planarize semiconductor, optical or magnetic substrates (not illustrated). The polishing pad typically includes a porous polyurethane matrix, but the matrix can be other polymers. Optionally, the polymeric matrix of the polishing pad 110 includes fluid-filled microspheres (not illustrated). Alternatively, the grooves can be combined with concentric circular, spiral, low flow grooves, X-Y grooves, concentric dodecagons, concentric hexagons, concentric hexdecagons, polygonal or other known groove shape. The polishing pad 110 has a polishing surface 116 that interacts with the semiconductor, optical or magnetic substrate. An opening 118 through the polishing pad 110 provides a location for securing a transparent window 120. When the polymeric matrix of the polishing pad 110 includes fluid-filled microspheres, they are preferably secured with a lateral spacing less than an average diameter of the fluid-filled microspheres. For example, casting the window in place provides a direct bond between the transparent window 120 and polishing pad 110 with essentially no space between transparent window 120 and polishing pad 110. A radius $R_2$ extends from the center 122 to the perimeter 124 of the polishing pad 110. Referring to FIG. 2A, a radial groove 114 extends from the radial debris drainage groove 114A to facilitate debris removal. The length of the radial debris drainage groove 114A extends about half the length of the transparent window 120.

Figure 2B:
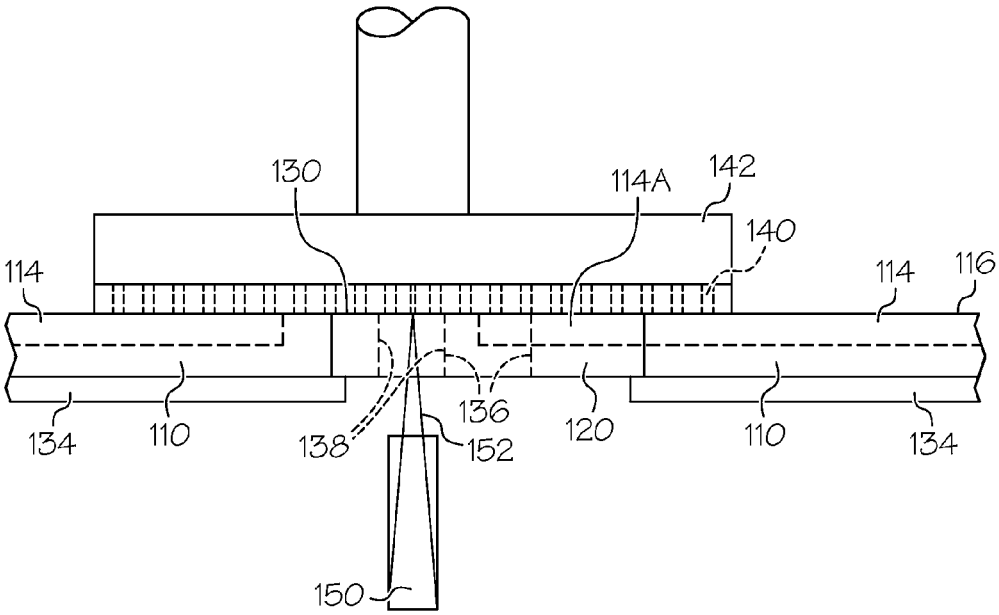
FIG. 2B is a radial cross section of the drained window of the FIG. 2 having a radial groove contiguous with a radial polishing pad groove prior to polishing.
Figure 2C:
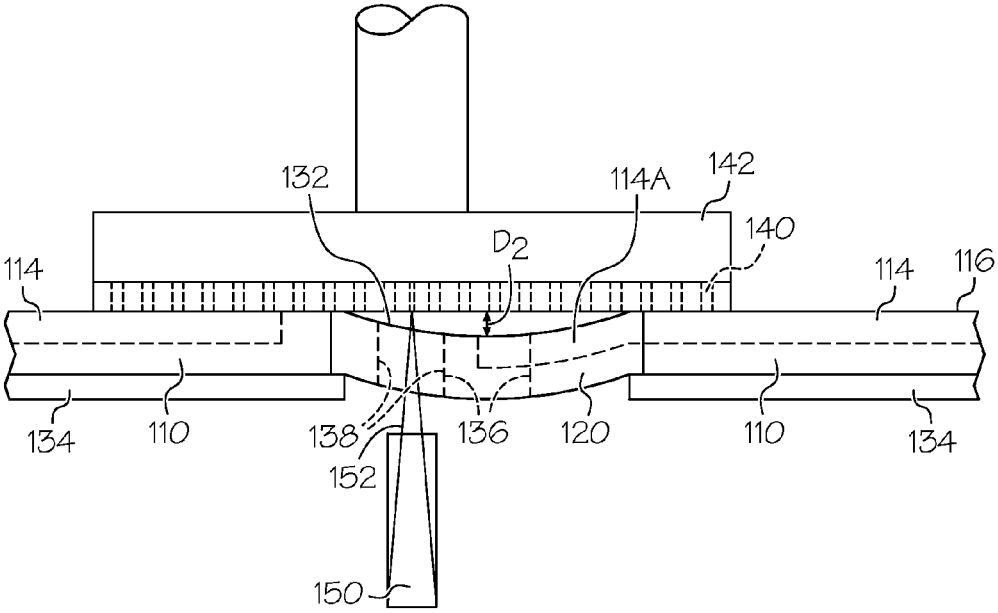
FIG. 2C is a radial cross section of a drained window of FIG. 2 having a radial groove contiguous with a radial polishing pad groove after polishing multiple wafers.

Referring to FIGS. 2B and 2C, the window 120 of polishing pad 110 can have either a flat surface 130 parallel with polishing surface 116 or concave surface 132 as measured with respect to the polishing surface 116. A subpad 134 supports the polishing pad 110 and the outer perimeter of the window 120. During polishing, the window 120 deforms and becomes concave. Typically, the window 120 becomes more and more concave as the polishing continues. The pad 110 optionally starts with a concave surface 132. The concave surface 132 has a maximum depth $D_2$ in a central region 136 of the transparent window 120 as measured from a plane of the polishing surface 116. During polishing the window 120 deforms to increase the height of $D_2$. A signal region 138 in the transparent window 120 is adjacent the central region 136 and on a side closest to the center 122 (FIG. 2) of the polishing pad 110. The signal region 138 transmits at least one of optical and or magnetic signals to a wafer 140 held by wafer carrier 142. The signal region 138 slopes downward into the central region 136 for facilitating debris removal. The debris drainage groove 114A extends through the central region 136 into the polishing pad 110 wherein rotating the polishing pad 110 with polishing fluid in the radial debris drainage groove 114A sends debris from the central region 136 into the polishing pad 110 through the radial debris drainage groove 114A. The depth of the radial debris drainage groove 114A is greater than the depth $D_2$ of the central region 136 as measured from the plane of the polishing surface 116.

During polishing endpoint detector 150 sends signal 152 through the signal region 138 of the transparent window 120 where it strikes wafer 140. The signal 152 then returns through signal region 138 where the endpoint detector 150 determines whether to continue or cease polishing of the wafer 140.

Figure 3A:
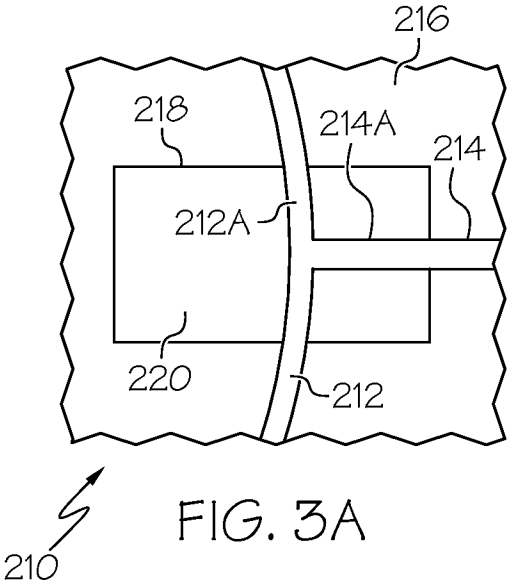
FIG. 3A is an enlarged schematic drawing of a drained window of FIG. 3.
Figure 3:
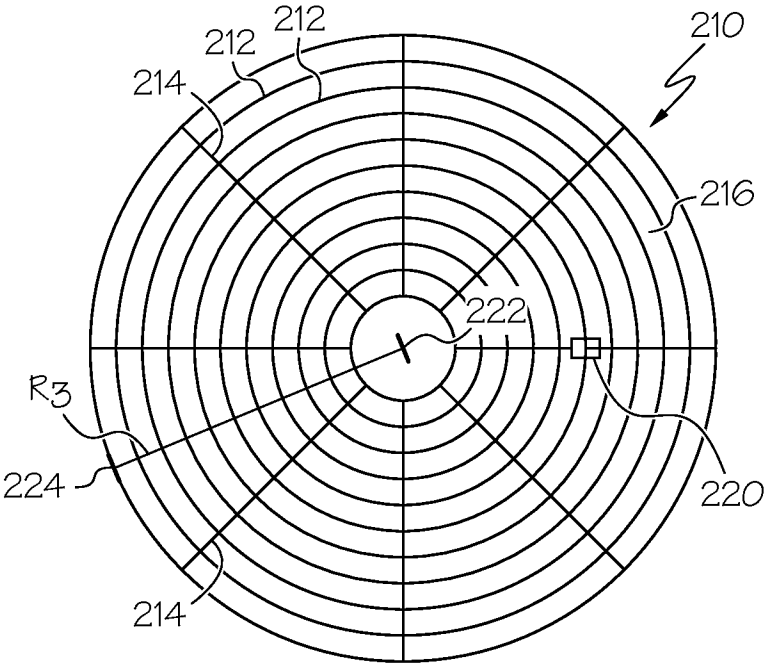
FIG. 3 is a schematic drawing of a drained window of the invention having a circumferential and a radial groove contiguous with both a circumferential and a radial polishing pad groove.

Referring to FIGS. 3 and 3A, the polishing pad 210 having concentric circular 212 and radial grooves 214 can polish or planarize semiconductor, optical or magnetic substrates (not illustrated). The polishing pad typically includes a porous polyurethane matrix, but the matrix can be other polymers. Optionally, the polymeric matrix of the polishing pad 210 includes fluid-filled microspheres (not illustrated). Alternatively, the grooves can be combined with concentric circular, spiral, low flow grooves, X-Y grooves, concentric hexagons, concentric dodecagons, concentric hexdecagons, polygonal or other known groove shape. The polishing pad 210 has a polishing surface 216 that interacts with the semiconductor, optical or magnetic substrate. An opening 218 through the polishing pad 210 provides a location for securing a transparent window 220. When the polymeric matrix of the polishing pad 210 includes fluid-filled microspheres, they are preferably secured with a lateral spacing less than an average diameter of the fluid-filled microspheres. For example, casting the window in place provides a direct bond between the transparent window 220 and polishing pad 210 with essentially no space between transparent window 220 and polishing pad 210. A radius $R_3$ extends from the center 222 to the perimeter 224 of the polishing pad 210. Referring to FIG. 3A, a circular groove 212 extends into the arc-shaped debris drainage groove 212A to facilitate debris removal. The arc-shaped debris drainage groove 212A runs the entire width of the transparent window 220 and connects with radial debris drainage groove 214A to allow debris to flow between the debris removal channels. A radial groove 214 extends from the radial debris drainage groove 214A to facilitate debris removal. The length of the radial debris drainage groove 214A extends about half the length of the transparent window 220.

Figure 3B:
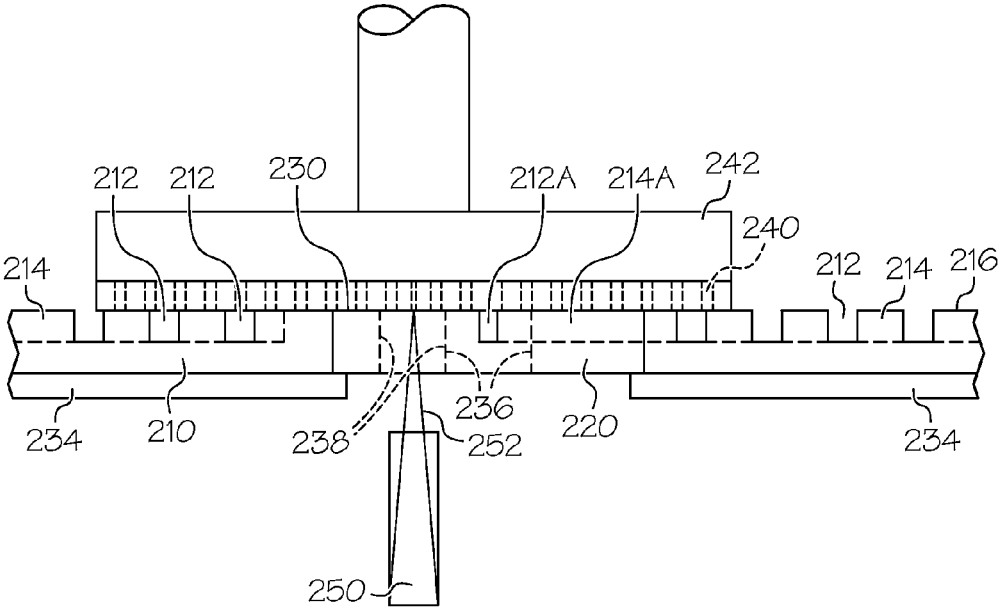
FIG. 3B is a radial cross section of the drained window of the FIG. 3 having a circumferential and a radial groove contiguous with both a circumferential and a radial polishing pad groove prior to polishing.
Figure 3C:
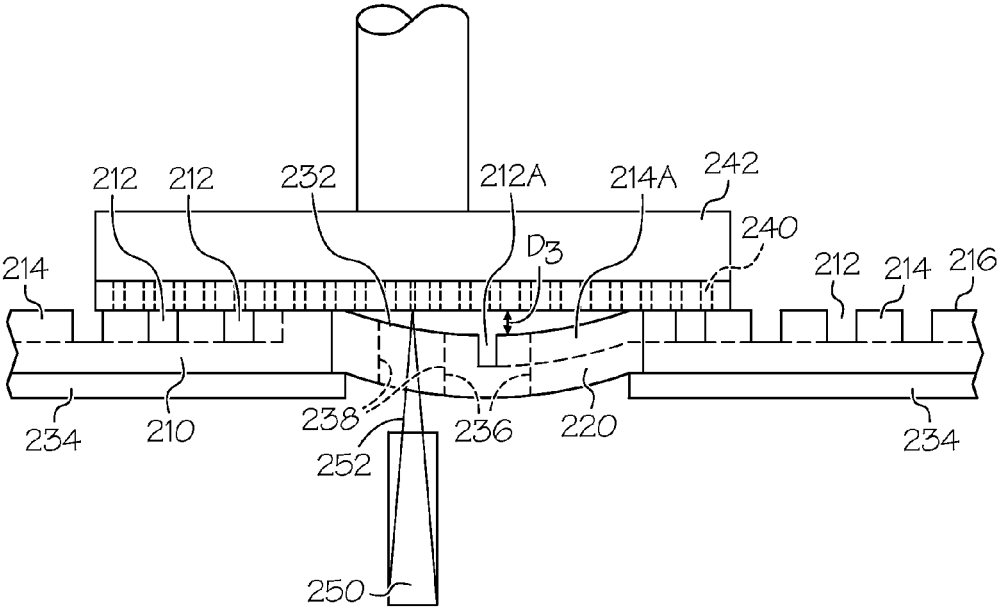
FIG. 3C is a radial cross section of a drained window of FIG. 3 having a circumferential and a radial groove contiguous with a circumferential and a radial polishing pad groove after polishing multiple wafers.

Referring to FIGS. 3B and 3C, the window 220 of polishing pad 210 can have either a flat surface 230 parallel with polishing surface 216 or concave surface 232 as measured with respect to the polishing surface 216. A subpad 234 supports the polishing pad 210 and the outer perimeter of the window 220. During polishing, the window 220 deforms and becomes concave. Typically, the window 220 becomes more and more concave as the polishing continues. The pad 210 optionally starts with a concave surface 232. The concave surface 232 has a maximum depth $D_3$ in a central region 236 of the transparent window 220 as measured from a plane of the polishing surface 216. During polishing the window 220 deforms to increase the height of $D_3$. A signal region 238 in the transparent window 220 is adjacent the central region 236 and on a side closest to the center 222 (FIG. 3) of the polishing pad 210. The signal region 238 transmits at least one of optical and or magnetic signals to a wafer 240 held by wafer carrier 242. The signal region 238 slopes downward into the central region 236 for facilitating debris removal. The debris drainage grooves 212A and 214A extend through the central region 236 into the polishing pad 210 wherein rotating the polishing pad 210 with polishing fluid in the debris drainage grooves 212A and 214A sends debris from the central region 236 into the polishing pad 210 through the debris drainage grooves 212A and 214A. The depths of the debris drainage grooves 212A and 214A are greater than the depth D3 of the central region 236 as measured from the plane of the polishing surface 216.

During polishing endpoint detector 250 sends signal 252 through the signal region 238 of the transparent window 220 where it strikes wafer 240. The signal 252 then returns through signal region 238 where the endpoint detector 250 determines whether to continue or cease polishing of the wafer 240.

The above examples are to circular, radial and combination circular plus radial. These examples operate by aligning the debris drainage groove with the polishing pad grooves. This concept will also work with other shaped grooves, such as spiral, low flow grooves, X-Y grooves, concentric hexagons, concentric dodecagons, concentric hexdecagons, polygonal or other known groove shape or combinations of these shapes. In these groove patterns, the debris drainage grooves align with the polishing pad grooves for effective debris removal.

The window of the invention provides a groove channel that functions to remove debris for concave polishing pad windows. Because the groove weakens the window structure to promote bending, it is counterintuitive to weaken the window structure. The window design of the invention removes debris while maintaining transparency for effective signal strength and endpoint detection.

The invention claimed is:

1. A polishing pad suitable for polishing or planarizing at least one of semiconductor, optical and magnetic substrates, the polishing pad having a polishing surface, an opening through the polishing pad, a radius that extends from a center of the polishing pad to a perimeter of the polishing pad and a transparent window within the opening in the polishing pad, the transparent window being secured to the polishing pad and transparent to at least one of magnetic and optical signals, the transparent window having a concave surface with respect to the polishing surface, the concave surface having a maximum depth in a central region of the transparent window as measured from a plane of the polishing surface that increases with use of the polishing pad; a signal region in the transparent window adjacent the central region and on a side closest to the center of the polishing pad for transmitting at least one of optical and or magnetic signals to a wafer, the signal region sloping downward into the central region for facilitating debris removal and a debris drainage groove extending through the central region into the polishing pad wherein rotating the polishing pad with polishing fluid in the debris drainage groove sends debris from the central region into the polishing pad through the debris drainage groove and wherein the depth of the debris drainage groove is greater than the depth of the central region.

2. The polishing pad of claim 1 wherein the debris drainage groove extends along the radius from the center of the polishing pad to the perimeter of the polishing pad.

3. The polishing pad of claim 1 wherein the debris drainage groove extends through a circumference of the polishing pad.

4. The polishing pad of claim 1 wherein the window is an optically transparent polymer.

5. The polishing pad of claim 1 wherein the polishing pad is porous, the transparent window is non-porous and casting of the polishing pad around the transparent window secures the transparent window to the polishing pad.

6. A polishing pad suitable for polishing or planarizing at least one of semiconductor, optical and magnetic substrates, the polishing pad containing fluid-filled microspheres and having a polishing surface, an opening through the polishing pad, a radius that extends from a center of the polishing pad to a perimeter of the polishing pad and a transparent window within the opening in the polishing pad, the transparent window being secured to the polishing pad with a lateral spacing less than an average diameter of the fluid-filled microspheres and transparent to at least one of magnetic and optical signals, the transparent window having a concave surface with respect to the polishing surface, the concave surface having a maximum depth in a central region of the transparent window as measured from a plane of the polishing surface that increases with use of the polishing pad; a signal region in the transparent window adjacent the central region and on a side closest to the center of the polishing pad for transmitting at least one of optical and or magnetic signals to a wafer, the signal region sloping downward into the central region for facilitating debris removal and a debris drainage groove extending through the central region into the polishing pad wherein rotating the polishing pad with polishing fluid in the debris drainage groove sends debris from the central region into the polishing pad through the debris drainage groove and wherein the depth of the debris drainage groove is greater than the depth of the central region.

7. The polishing pad of claim 6 wherein the debris drainage groove extends along the radius from the center of the polishing pad to the perimeter of the polishing pad.

8. The polishing pad of claim 6 wherein the debris drainage groove extends through a circumference of the polishing pad.

9. The polishing pad of claim 6 wherein the window is an optically transparent polymer.

10. The polishing pad of claim 6 wherein the polishing pad is porous, the transparent window is non-porous and casting of the polishing pad around the transparent window secures the transparent window to the polishing pad.

* * * * *